US005906005A

United States Patent [19]

Niskala et al.

[11] Patent Number: 5,906,005

[45] Date of Patent: May 25, 1999

[54] PROCESS AND APPARATUS FOR MAKING PHOTOREALISTIC MASKS AND MASKS MADE THEREBY

[75] Inventors: Wayne F. Niskala; Richard A. Simon; Joseph A. Manico, all of Rochester; W. Patrick Fricke, Fairport; Kristine A. Moon, Rochester, all of N.Y.

[73] Assignee: Eastman Kodak Company, Rochester, N.Y.

[21] Appl. No.: 08/895,444

[22] Filed: Jul. 16, 1997

[51] Int. Cl.[6] ..... A42C 1/00

[52] U.S. Cl. ..... 2/206; 2/173; 347/3

[58] Field of Search ..... 2/173, 206; 347/2, 347/3, 111, 171; 348/77; 396/322, 331, 332, 333, 334; 446/27

[56] References Cited

U.S. PATENT DOCUMENTS 4,929,213 5/1990 Morgan .

5,009,626 4/1991 Katz .

5,280,305 1/1994 Monroe et al. .

OTHER PUBLICATIONS

R. Brunelli and T. Poggio, "Face Recognition: Features versus Templates", *IEEE Transactions on Pattern Analysis and Machine Intelligence,* vol. 15, No. 10, Oct. 1993, pp. 1042–1052.

*Primary Examiner*—Diana L. Biefeld

*Attorney, Agent, or Firm*—Thomas H. Close

[57] ABSTRACT

A method of making a mask representing a photographic subject includes the steps of: simultaneously capturing a front and two side face views of the subject using a single camera and a pair of mirrors, one mirror on each side of the subject's head; forming a digital image of the captured front and side views; digitally processing the digital image by mirroring the two side views and blending the two side views with the front view to form a blended image; and transferring the blended image to a head sock.

19 Claims, 8 Drawing Sheets

PROCESS AND APPARATUS FOR MAKING PHOTOREALISTIC MASKS AND MASKS MADE THEREBY

FIELD OF THE INVENTION

The invention relates to a method and apparatus for making a photorealistic mask, such as a form fitting stocking mask using real photographic images, and masks made thereby.

BACKGROUND OF THE INVENTION

It is known to make masks using photographic images. Generally known techniques for making such masks include capturing the image and digitally distorting the image to adapt it to the shape of a mask. For example, U.S. Pat. No. 4,929,213, issued May 29, 1990, to Morgan, discloses a method for single image capture and thermal image transfer. This method requires thermal image transfer to a block of compliant foam material and relics on the shape of the foam block alone to restore the 3 dimensional appearance to the 2 dimensional image. This process does not lend itself to producing realistic appearing masks.

U.S. Pat. No. 5,009,626, issued Apr. 23, 1991, to Katz discloses a method for distorting an image and forming an azimuthal type group (like a "world map"), which when printed on fabric, cut and assembled in a three dimensional format, forms a full head fabric mask. Katz refers to various capture techniques such as flat, stereoscopic, topographical, or panoramic. Katz discloses using two cameras to capture front and side or back, a flexible print-accepting material suitable for fabricating a skin-like facial surface for people dolls, mannequins and humanoids or hair-like appearance for animal dolls and toys. Katz also list a series of flexible type fabrics. Katz also discloses three capture/process techniques; flat frontal with shading to yield the 3-D appearance, azimthal type for cut out and assemble, and computer correlated, molding and stretching. A shortcoming of all the methods disclosed is that the image must be transferred to the material prior to constructing the mask, thereby limiting the use of the techniques for while-you-wait retail sales locations such as found in theme parks and novelty stores. A further limitation of the techniques disclosed by Katz is the need for a skilled operator to manipulate the image.

U.S. Pat. No. 5,280,305, issued Jan. 18, 1994, to Monroe et al. discloses using a computer to distort or warp a frontal 2-D image. An optional approach is described where a series of video frames are captured and the best one is selected for the mask image. The image is output onto heat deformable plastic, and vacuum forming on a generic face mold is used to form the mask. This approach does not yield realistic looking masks since the generic face form does not fit all user's faces.

SUMMARY OF THE INVENTION

The present invention is directed to overcoming one or more of the problems set forth above. Briefly summarized, according to one aspect of the present invention, a method of making a mask representing a photographic subject includes the steps of: simultaneously capturing a front and two side face views of the subject using a single camera and a pair of mirrors, one mirror on each side of the subject's head; forming a digital image of the captured front and side views; digitally processing the digital image by mirroring the two side views and blending the two side views with the front view to form a blended image; and transferring the blended image to a head sock.

According to a further aspect of the invention, the edges of the mirror fixture are of a known color, such as that used in "blue screens" so that they can be automatically recognized by the digital image processing computer. The blending algorithm interprets the positions of the mirror by recognizing these "blue screen" colored edges.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention has the following advantages. A realistic mask is produced in a simple, cost effective, timely manner. The mask is comfortable, form fitting and may be made from a fabric that provides adequate ventilation. Multiple, simultaneous views of a subject's head are captured with a single exposure from a conventional or digital camera. The mirror fixture is also used to aid in positioning the subject's head in the camera frame. The gap between the mirrors and the mirror angles are adjustable to accommodate a range of head shapes and sizes. Markers on the mirror fixture can be used to determine the mirror position and angle for use by the blending algorithm.

The operator need not be highly skilled in digital image manipulation since the software algorithm requires only minimal intervention. The operator simply positions several control points on the front and side images before the automatic algorithm is initiated.

DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
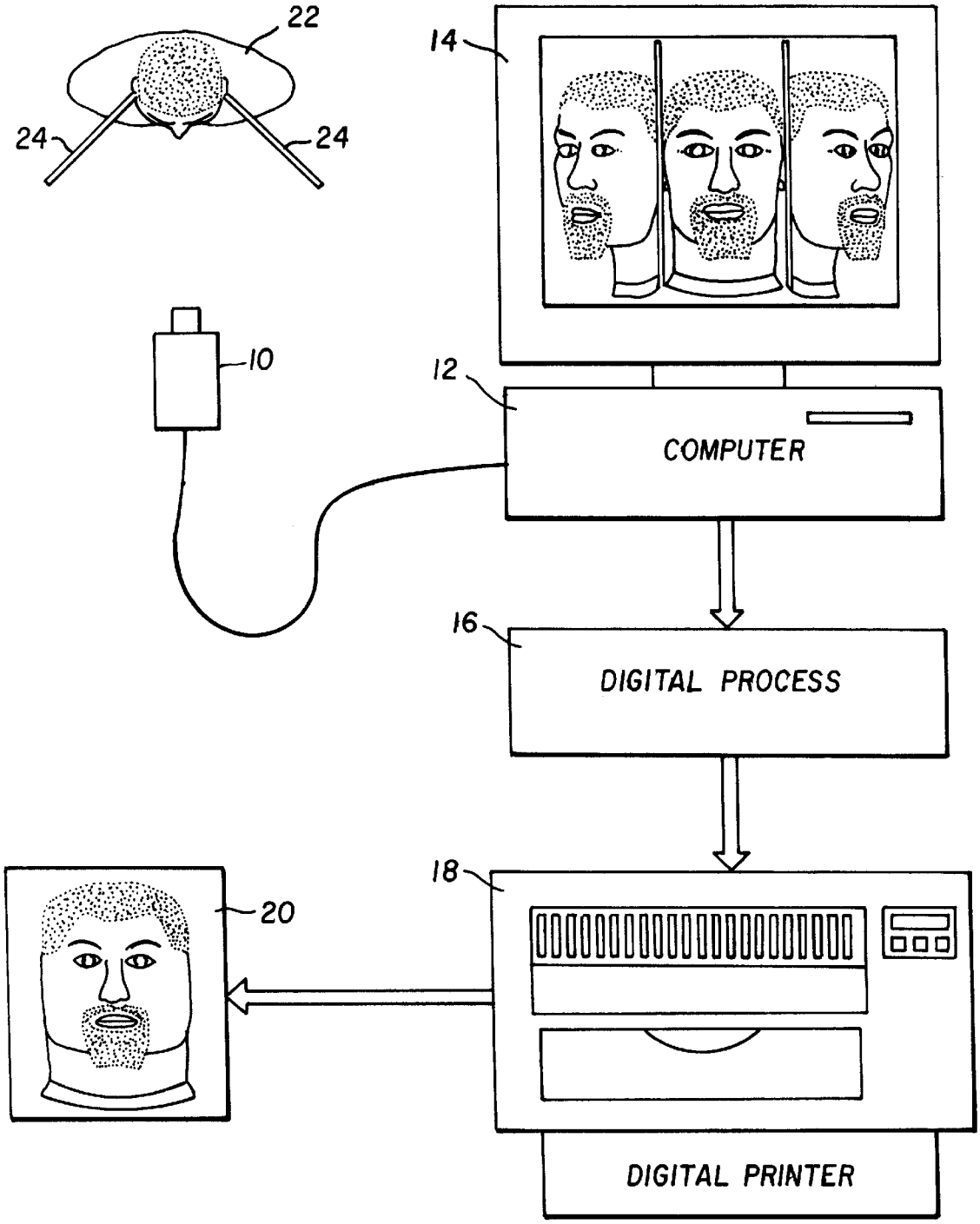
FIG. 1 is a schematic diagram of a system for creating the image used to make a mask according to the present invention.

Beginning with FIG. 1, digital camera 10 is connected to computer 12. Subject 22 is positioned so that his face is flanked on both sides by mirror fixture 24. The image of the subject's face, facial reflections, and mirror fixture 24 are captured by camera 10 and then is displayed on computer monitor 14. The displayed image on monitor 14 corresponds to a 180 degree view of the face. To easily and robustly generate the front of the mask, three views of the face are simultaneously captured. The three views correspond to ¾ views of the left and right side of the face and a straight on view of the front of the face. The side images and the front image contain redundant information of the face captured at different viewpoints. Alternatively, images used to create a custom phatographic mask are captured on film using the mirror fixture and then digitally scanned to produce the digital image. Alternatively, the images can be captured by an analog video camera and then digitized. The three views are digitally processed as described below by a digital processing program 16 which is resident in computer 12. The processed digital image 20 is then printed by digital printer 18. Digital image 20 is printed for example using an electrophotograhic, ink jet, or thermal printer using thermal re-transfer media designed for transfer to fabric. Alternatively, the digital image may be directly printed on a blank fabric head sock, using for example an ink jet printer.

Figure 2:
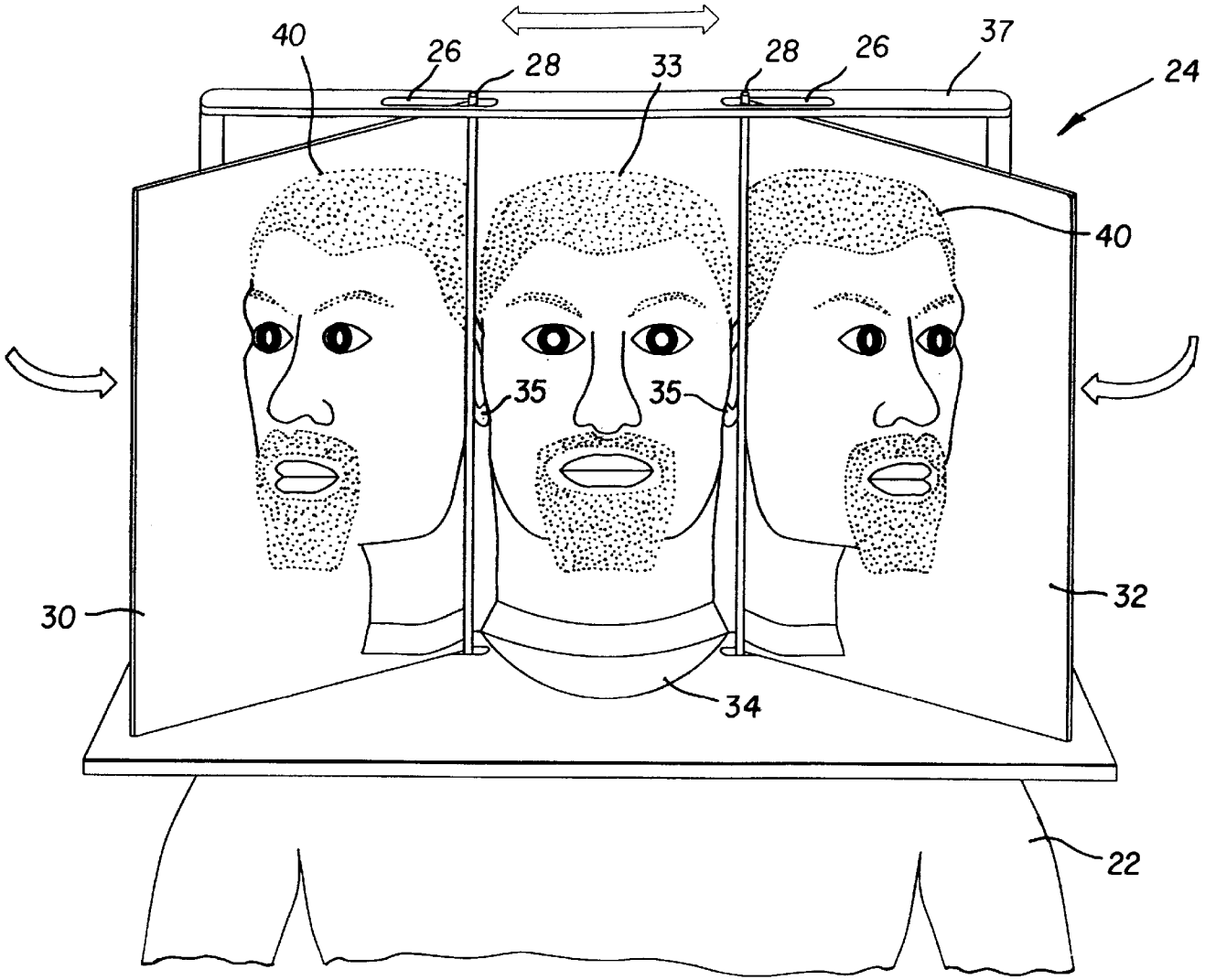
FIG. 2 is a perspective view of a mirror fixture employed to capture a photographic image according to the present invention.

FIG. 2 is a perspective view of a mirror fixture, generally designated 24, employed to capture a photographic image of subject 22. A right mirror 30 and a left mirror 32 are brought into contact with the sides of the face 33 of subject 22 just in front of the subject's ears 35 by means of adjustment slots 26 in a frame 37 and pivots 28 on mirrors 30 and 32. A cutout 34 is provided in the base of frame 37 to accommodate the subject's neck. The side images 40 of the subject's face are adjusted by rotating mirrors 30 and 32 about pivots 28.

Figure 3:
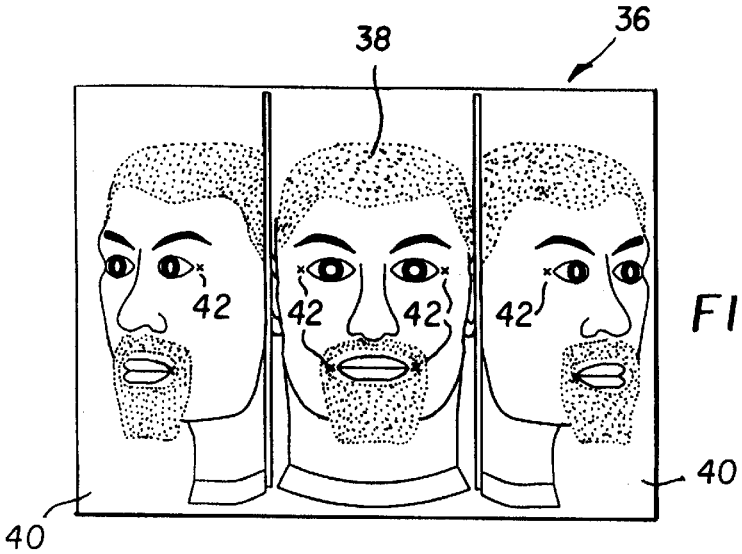
FIGS. 3–8 are graphics used to illustrate the image processing steps according to the present invention.

FIGS. 3–8 are graphics used to illustrate the image processing steps according to the present invention. Control points 42 are defined, either by a user operating a user pointing device such as a mouse, or automatically by means of a feature finding algorithm, at the corners of the eyes and mouth of the subject's face. Using control points 42, a portion of the side view images are extracted and horizontally flipped to form horizontally flipped side images 48. The flipped side view images are then aligned onto the front view image using the defined front and side view control points 42. Referring to FIG. 3 an image displayed on a computer monitor of the subject's mirror fixture image 36 with front image 38 and side images 40 is shown. An operator manually places control points 42 on the images of the subject at the corners of the mouth and at the outside corner of each eye on the front 38 and side 40 images. User defined control points 42 are used to extract the relevant data from each view and link the same physical features in the different views.

Figure 4:
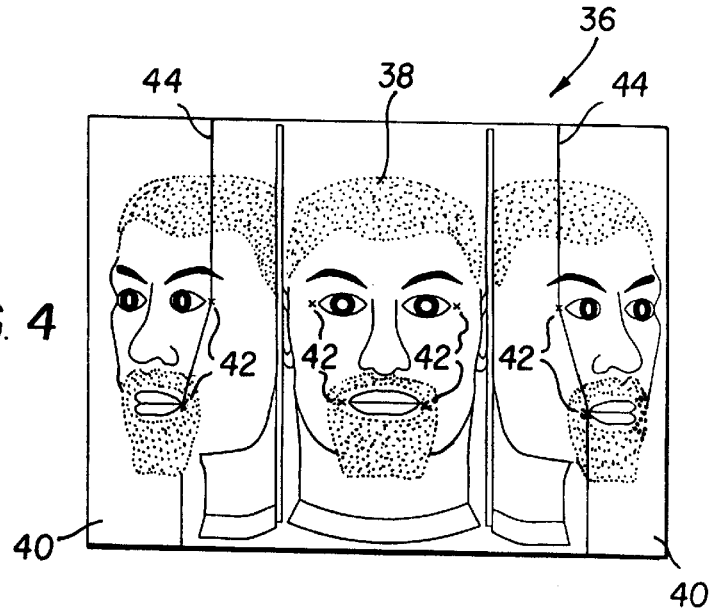
Figure 5:
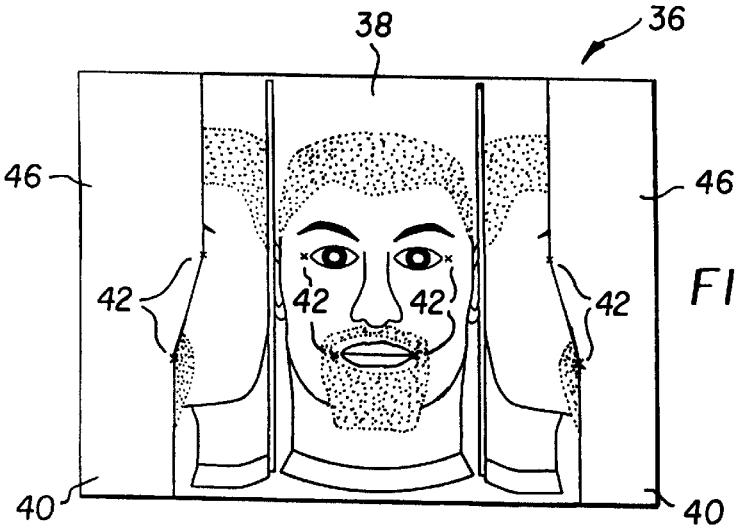
Figure 6:
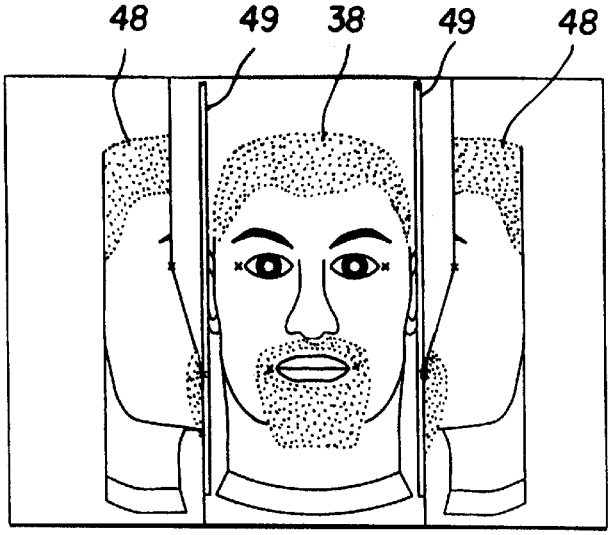
Figure 7:
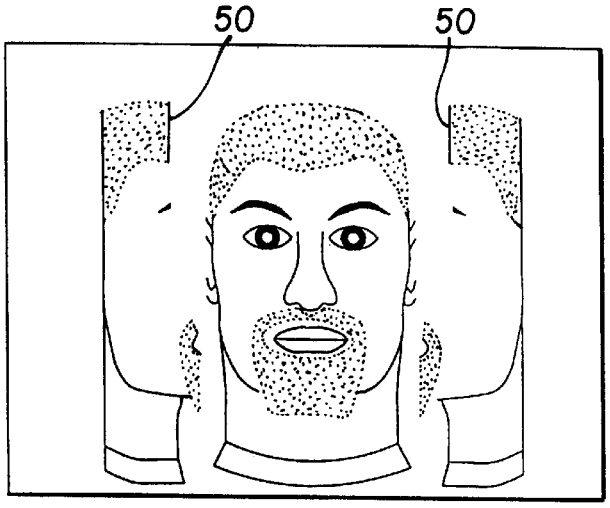
Figure 8:
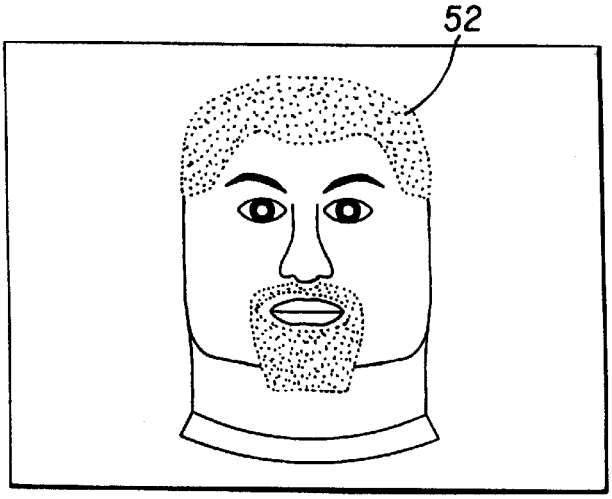

FIG. 4 illustrates the automatic addition of lines 44 connecting control points 42 on the side images 40. FIG. 5 illustrates the removal of unused areas 46 outside of lines 44 of side image 40. FIG. 6 illustrates the remaining sections of the images which have been horizontally flipped 48 and the image of side mirror edges 49. FIG. 7 illustrates the flipped side images with all control points and connection lines 50 and mirror edges 49 removed. FIG. 8 illustrates the results of moving the side images 40 towards and blended with the front image yielding the completed image 52.

To generate an apparently seamless image for the front of the mask, the extracted image data from the front and side images are digitally blended together to hide edges. Further scaling of the front mask image may also be employed to ensure that it fits into the pre-defined area of the physical mask. These procedures can be repeated for the back side of the mask with images of the back of the user's head using similar techniques to those described above, with appropriately selected control points. The back surface of the mask can be created as previously described, or can be pre-printed with generic images of hair, hats, etc., or can be constructed with an opaque dark color or shear translucent fabric to avoid the need for a second image to further reduce complexity and cost.

Figure 9:
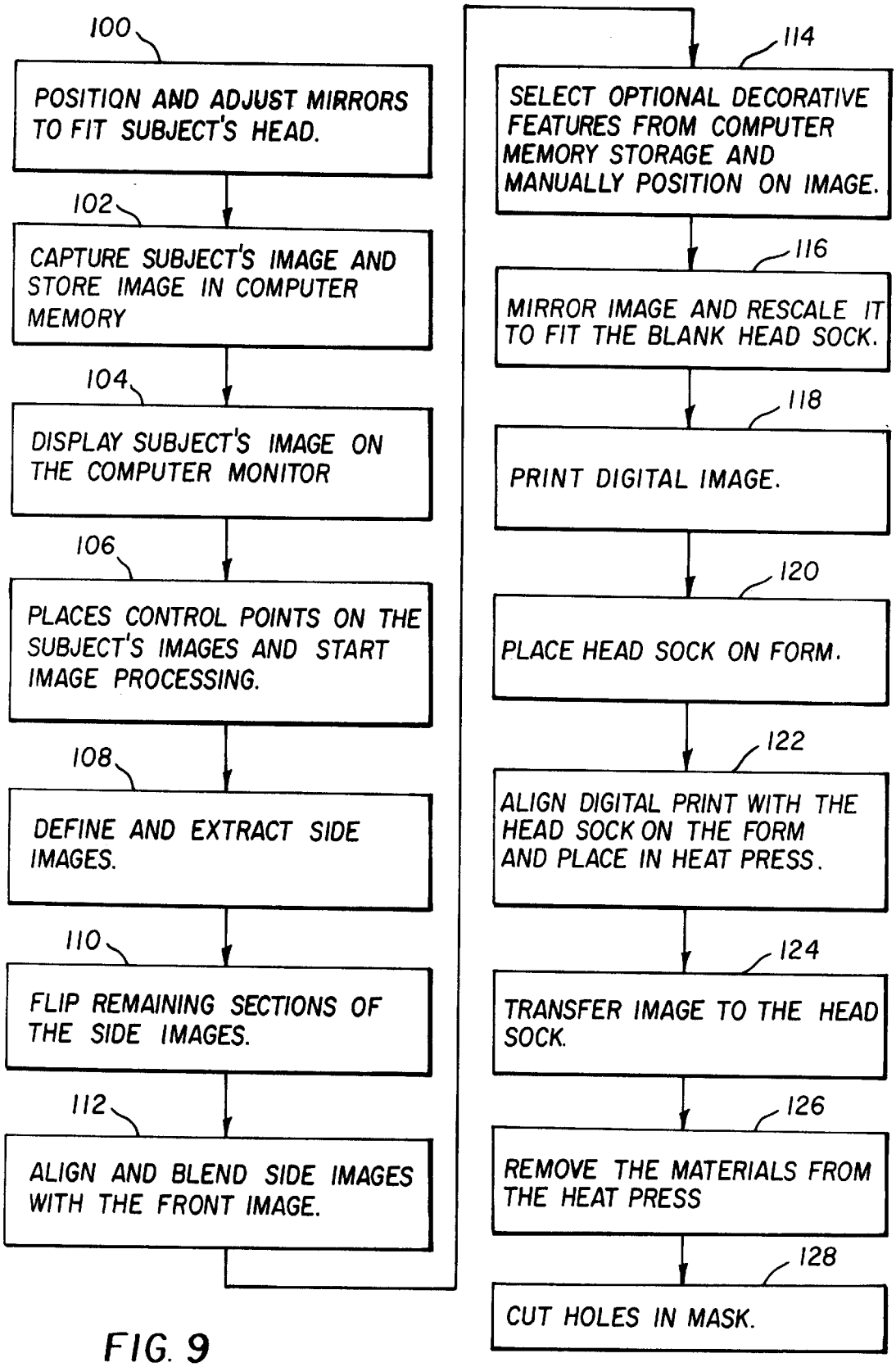
FIG. 9 is a flow chart showing the image processing steps performed by the present invention.

The process of generating the mask image will now be described with reference to FIG. 9. First, the user's face is positioned 100 in the mirror fixture; the mirrors are adjusted to fit the user's head size. Next, the user's image is captured with a digital camera and stored in a computer memory 102. The user's front face image and adjacent side mirror images are displayed on a computer monitor 104. The operator manually places control points on the user's images and initiates the image processing algorithm 106. The algorithm defines the selected sections of the side images using the control points and removes the unwanted sections 108. Next, the algorithm flips the remaining sections of the side images 110. The remaining sections of the side images are then aligned and blended with the front face image using the control points for positioning reference 112. Optionally, decorative features stored in the computer memory, such as scars, makeup, facial hair, cyborg modules, horns, scales, warts, fangs, tattoos, etc. are selected by the operator and added to the image 114.

If the image is to be transferred to the head sock using an intermediate transfer medium, the resulting image is flipped horizontally prior to output to the transfer medium 116. If the image is to be printed directly on the head sock, this flipping step is not employed. The digital image is then printed 118 onto the transfer medium, or directly onto the head sock material. If the image was printed onto a transfer medium, a blank head sock is stretched over a mask form and the material in the head sock seam is placed behind the form 120. The print transfer medium is aligned with the front surface of the head sock on the form, and both are placed in a heat press 122. The heat press is actuated to transfer the image to the head sock 124. The materials are removed from the heat press and the transfer medium is separated from the mask. The form is removed from the mask 126. Finally, holes for the user's ears, mouth, and eyes are cut from the mask to complete the fabrication of the mask 128.

A computer program written in the C++ language for implementing the image processing functions described above is included in Appendix A.

Figure 10:
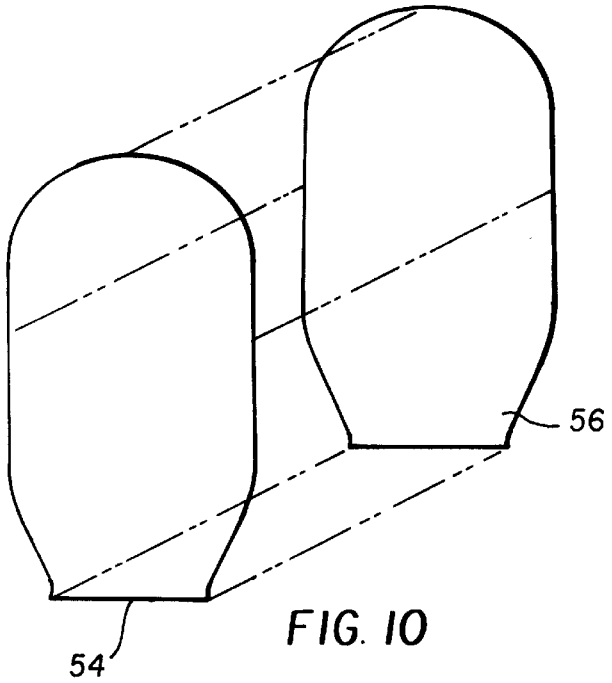
FIG. 10 is an exploded perspective view of the head sock used to create the mask according to the present invention.

FIG.10 shows the front panel 54 of a head sock and the rear panel 56 of the head sock aligned for assembly. The head sock is assembled by aligning the two matching shaped front and back panels, rounded at the top, narrow at the neck, seamed at edge of the front and back panels, and open at the bottom. The head sock is then turned inside out to conceal the seam.

Figure 11:
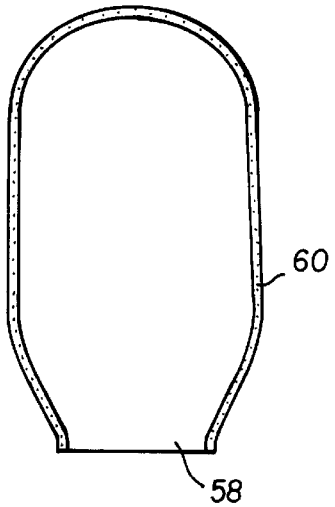
FIG. 11 is a view of the assembled head sock prior to image application.

FIG. 11 shows a cross sectional view of the assembled head sock with neck opening 58 and interior seam 60. The preferred fabric used to construct the head sock is a white colored cotton/lycra blend (90%/10%). Cotton provides comfort, breathability, compatibility with various image transfer media and direct printing techniques. Lycra is used to make the head sock elastic allowing it to conform to the user's facial features. White colored material is preferred for image transfer and direct printing. If the percentage of Lycra is too high, breathability will be effected and the fabric will melt if a heat type image transfer process is used. The location of the seam between the front and back of the user's head, along the line where the ears are attached to the head, makes the seam less noticeable and provides the option for single or dual sided printing.

Figure 12:
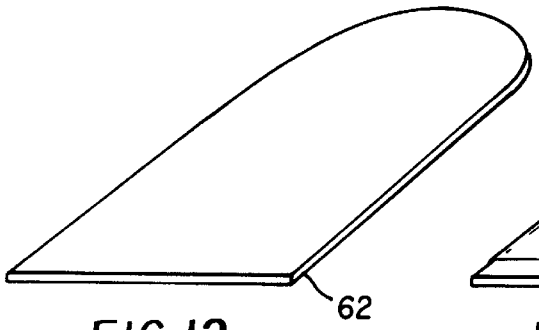
FIG. 12 is a plan view of the form employed in applying the image to the head sock.

FIG. 12 shows a head sock holding form 62. The head sock holding form 62, made of cardboard, masonite, or temperature resistant plastic, is used to stretch and shape the head sock for image transfer and direct printing applications. The head sock holding form 62 is basically rectangular with the top rounded to fit the shape of the head sock.

Figure 13:
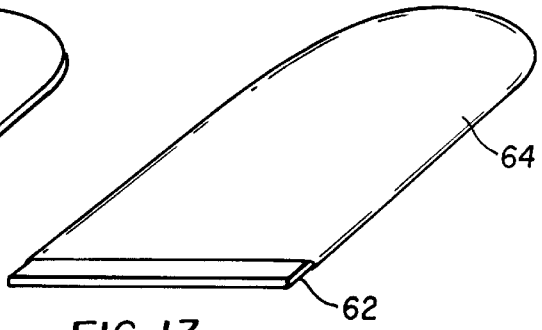
FIG. 13 is a plan view showing the form in the head sock.
Figure 14:
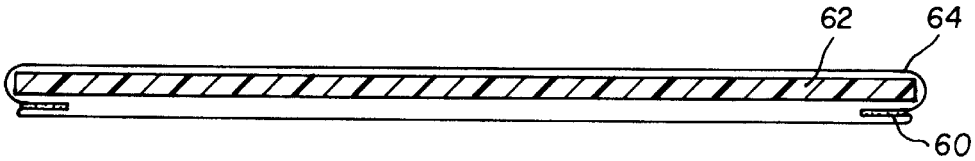
FIG. 14 is an end view of the form in the head sock.

FIG. 13 shows the assembled head sock 64 on head sock holding form 62. FIG. 14 is a cross sectional view of head sock 64 over holding form 62 with internal seam 60 placed behind holding form 62. Because the excess material of the seam would interfere with direct printing and image transfer if not placed behind the insert, the excess material is placed behind the holding form 62, on the side opposite of the side that will receive the image during printing or image transfer. This procedure is repeated if dual sided masks are required, to provide a smooth continuous surface for image printing or transfer.

Figure 15:
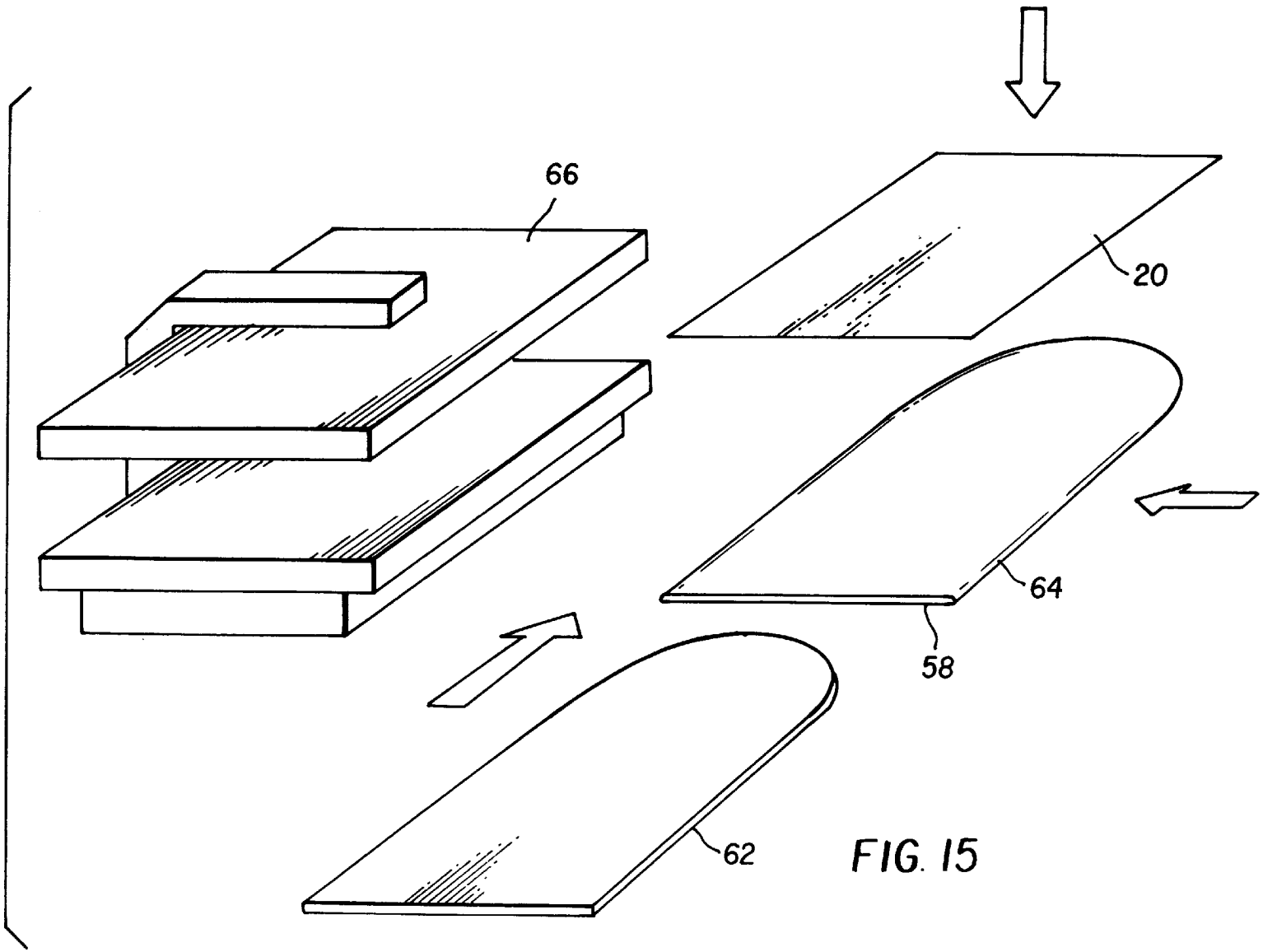
FIG. 15 is a schematic diagram showing the transfer of the processed image to a head sock to complete the mask of the present invention.

FIG. 15 shows thermal transfer press 66 with mask holding form 62 being inserted into blank mask 64 via neck opening 58. Digital print 20 is placed on top of blank mask 64 with the image side of the print in contact with the top surface of the blank mask. Once the holding form 62 has been inserted into the blank mask 64, and the digital print 20 is placed on top of the blank mask, the entire assembly is placed into the thermal transfer press 66 and the image is transferred to the blank mask.

Figure 16:
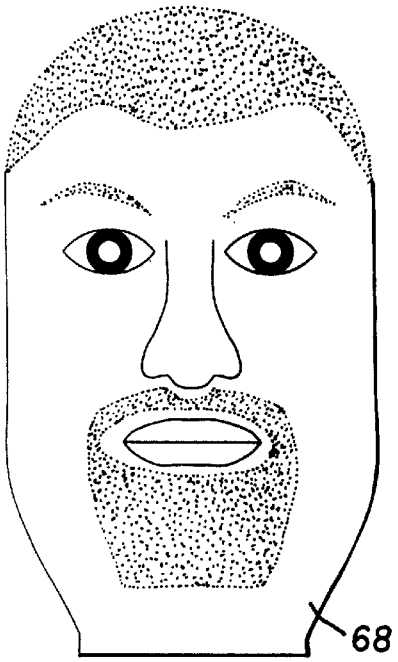
FIG. 16 is a plan view showing the completed mask prior to cutting holes for the eyes and mouth.
Figure 17:
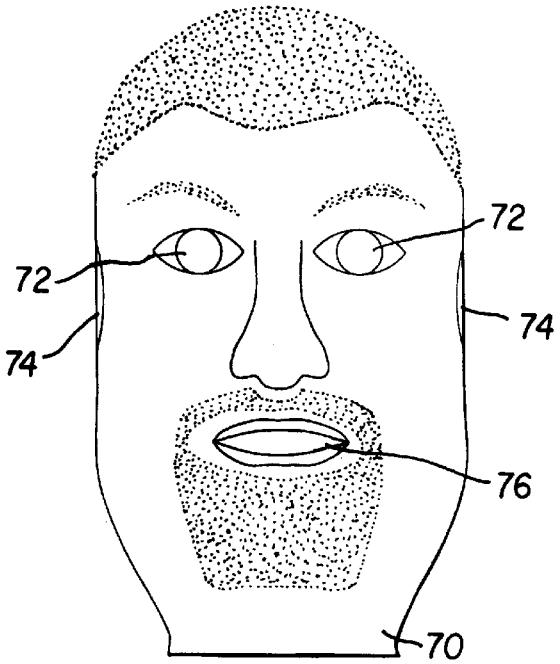
FIG. 17 is a plan view of a completed mask according to the present invention.

FIG. 16 shows the head sock with the transferred image 68. FIG. 17 shows a completed mask 70 with eye holes 72, ear slits 74, and mouth slit 76. The operator uses the actual printed images of the subject's eyes and mouth printed on the mask as a guide to punching eye holes and cutting a mouth slit. The seam can be split for the ear holes, before or after image transfer, at two locations, on the sides, to allow the user to pull his/her ears through the mask. Exposing the user's ears adds to the overall "realism" of the mask and it helps to pull the mask against the user's facial features.

Figure 18:
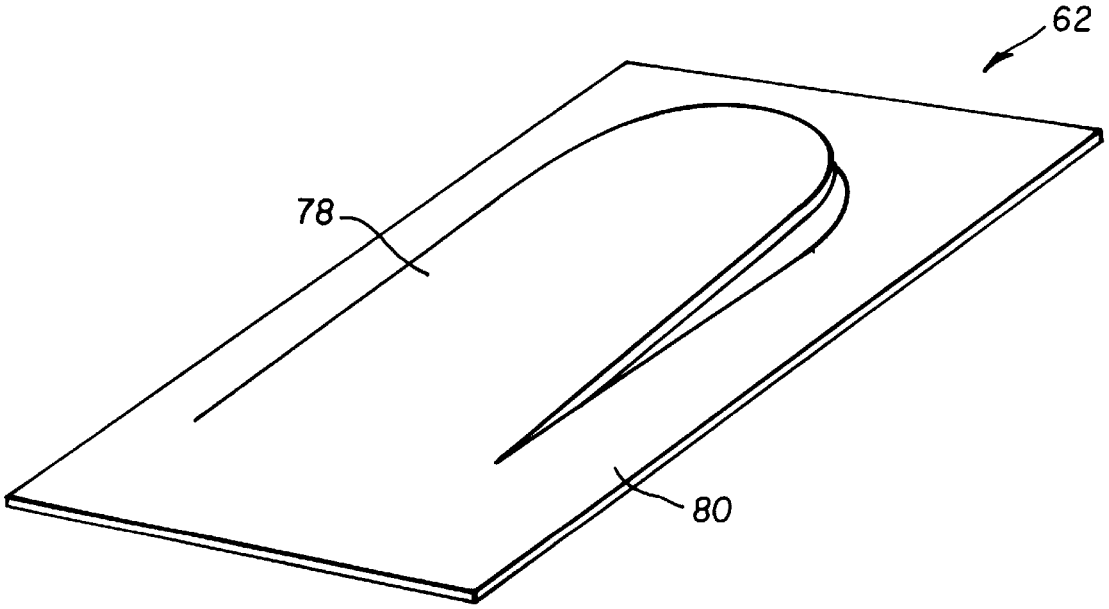
FIG. 18 is a perspective view of an alternative construction of the form.

Referring to FIG. 18, the holding form 62 can be made punching out a flap 78 in a sheet of cardboard, to incorporate a surround area 80 that is attached at the bottom end of the 78. The surround area 80 is effective to catch any image over-bleed and to aid in media transport in a printing device. The holding form can be made to be single use, reusable, and/or washable.

The invention has been described with reference to a preferred embodiment. However, it will be appreciated that variations and modifications can be effected by a person of ordinary skill in the art without departing from the scope of the invention. For example, additional decorative articles, such as a hat, hood, horns, hair, antennae, or antlers can be attached to the completed mask.

APPENDIX A

```
#include <math.h>
void main()
{
        int i,j;
        int x1,y1,x3,y3,x4,y4;
        int x6,y6,x7,y7,x8,y8;
        int pixels, lines, pixels_out, lines_out, picsize_out, feather_pixels;
/*****************************************************************/
//    (x1,y1) = eye corner right side view (x3,y3) = mouth corner right side
//    (x6,y6) = eye corner left side view (x8,y8) = mouth corner right side
//    (x4,y4) = right mouth corner front view
//    (x7,y7) = left mouth corner front view
//    imgR[], imgG[], and imgB[] arrays contain RGB of lines x pixels captured image
//    feather_pixels = number of pixels used for blending side and front images
/*****************************************************************/
    float feather = 1.0 / (float)feather_pixels;
        float slope1 = ( (float)y1 - (float)y3 ) / ( (float)x1 - (float)x3 );
        float vint1 = (float)y1 - (float)x1 * slope1;
        float slope2 = ( (float)y6 - (float)y8 ) / ( (float)x6 - (float)x8 );
        float vint2 = (float)y6 - (float)x6 * slope2;
        // Determine location of boundaries between mirrors
        unsigned char Rmask = 90;
        unsigned char Gmask = 241;
        unsigned char Bmask = 14;
        unsigned char Dmask = 10;
        float *mask;
        int istart, iend, xstop;
        int in = -1, ibox1 = 1000000, ibox2= -1, iflag = 0;
        for (i = 0; i < lines; i++)
        {
                istart = -1;
                iend = -1;
                for (j = 0;j < pixels;j++)
                {
                in++;
            if( (imgG[in] <= (Gmask+Dmask)) &&
                    (imgG[in] >= (Gmask-Dmask)) )
                {
                    if( (imgR[in] <= (Rmask+Dmask)) &&
                        imgR[in] >= (Rmask-Dmask)) )
                    {
```

APPENDIX A-continued

```
                                if( (imgB[in] <= (Bmask+Dmask)) &&
                                    (imgB[in] >= (Bmask-Dmask)) )
                                {
                                    iflag=1;
                                    if(istart == -1)
                                    {
                                        istart = j;
                                    }
                                }
                            }
                        }
                            if(iflag == 1)
                            {
                              iend = j;
                                iflag=0;
                        }
                    }
                    if (istart < ibox1)
                    {
                            ibox1 = istart;
                        }
                        if (iend > ibox2)
                        {
                            ibox2 = iend;
                        }
            }
//      Right Side of Image
        // Create mask image arrays
        lines_out = lines;
        pixels_out = ibox1 - x3;
        picsize_out = lines_out * pixels_out;
        red = new unsigned char [m_picsize_out];
        grn = new unsigned char [m_picsize_out];
        red = new unsigned char [m_picsize_out];
mask = new float [m_picsize_out];
        //Read flipped images into mask arrays
int out1 = -1;
        for (i = 0; i <lines_out; i++)
        {
                    out1 = (i+1) * pixels_out -1;
                    in=x3 +i * pixels;
                    if(i < y1)
                    {
                      for (j = 1; j <= (x1-x3); j++)
                      {
                                red[out1] = imgR[in];
                                grn[out1] = imgG[in];
                                blu[out1] = imgB[in];
                                mask[out1] = 0.0;
                                out1--;
                        in++;
                      }
                      for (j = 1; j <= feather_pixels; j++)
                      {
                                red[out1] = imgR[in];
                                grn[out1] = imgG[in];
                                blu[out1] = imgB[in];
                                mask[out1] = (float)j * feather;
                                out1--;
                        in++;
                      }
                      for (j = (x1-x3)+feather_pixels+1; j <= pixels_out; j++)
                      {
                                red[out1] = imgR[in];
                                grn[out1] = imgG[in];
                                blu[out1] = imgB[in];
                                mask[out1] = 1.0;
                                out1--;
                        in++;
                      }
                    }
        elseif ((i >= y1)&&(i < y3))
        {
                    xstop = ( (float) - vint1 ) / slope1;
                    for (j = 1; j <= (xstop-x3); j++)
                    {
                                red[out1] = imgR[in];
                            grn[out1] = imgG[in];
                            blu[out1] = imgB[in];
```

APPENDIX A-continued

```
                mask[out1] = 0.0;
                out1--;
                    in++;
            }
            for (j = 1; j <= feather_pixels; i++)
            {
                    red[out1]= imgR[in];
                grn[out1] = imgG[in];
                blu[out1] = imgB[in];
                mask[out1] = (float)j * feather;
                out1--;
                    in++;
            }
            for (j = (xstop-x3+feather_pixels+1); j < pixels out; j++)
            {
                    red[out1] = imgR[in];
                grn[out1] = imgG[in];
                blu[out1] = imgB[in];
                mask[out1] = 1.0;
                out1--;
                    in++;
            }
    }
    else
    {
            for (j = 1; j <= feather_pixels; j++)
            {
                    red[out1] = imgR[in];
                grn[out1] = imgG[in];
                blu[out1] = imgB[in];
                mask[out1] = (float)j * feather;
                out1--;
                    in++;
            }
            for (j = feather_pixels+1; j <= pixels_out; j++)
            {
                    red[out1] = imgR[in];
                grn[out1] = imgG[in];
                blu[out1] = imgB[in];
                mask[out1] = 1.0;
                out1--;
                    in++;
            }
        }
    }
    // Combine side image with front view image
    in = 0;
    for (i = 0; i <lines_out; i++)
    {
        out1 = i * pixels + (x4 - pixels_out);
        for (j = 1; j <= pixels_out; j++)
        {
                imgR[out1] = (1. - mask[in]) * (float)imgR[out1] +
                    mask[in] * (float)red[in];
                imgG[out1] = (1. - mask[in]) * (float)imgG[out1] +
                    mask[in] * (float)grn[in];
                imgB[out1] = (1. - mask[in]) * (float)imgB[out1] +
                    mask[in] * (float)blu[in];
                in++;
                out1++;
        }
    }
    delete [] m_red
    delete [] m_grn;
    delete [] m_blu
    delete [] mask;
//  Left Side of Image
    //Create mask image arrays
    lines_out = lines;
    pixels_out = x8 - ibox2;
    picsize_out = lines_out * pixels_out;
    red = new unsigned char [m_picsize_out]);
    grn = new unsigned char [m_picsize_out]);
    red = new unsigned char [m_picsize_out]);
mask = new float [m_picsize_out]);
        //Read flipped images into mask arrays
        for (i = 0; i < lines_out; i++)
        {
            out1 = (i+1) * pixels_out-1;
```

APPENDIX A-continued

```
        in = ibox2 + i * pixels;
        if ( i < y6)
        {
            for (j = 1; j < = (x6−ibox2−feather_pixels); j++)
            {
                red[out1] = imgR[in];
                grn[out1] = imgG[in];
                blu[out1] = imgB[in];
                mask[out1] = 1.0;
                out1−−;
            in++;
        }
        for (j = 1; j <= feather_pixels; j++)
        {
                red[out1] = imgR[in];
                grn[out1] = imgG[in];
                blu[out1] = imgB[in];
                mask[out1] = 1 − (float)j * feather;
                out1−−;
            in++;
        }
        for (j = 1; j <= (x8−x6); j++)
        {
                red[out1] = imgR[in];
                grn[out1] = imgG[in];
                blu[out1] = imgB[in];
                mask[out1] = 0.0;
                out1−−;
            in++;
            }
        }
elseif ((i >= y6)&&(i < y8))
        {
            xstop = ( (float)i − vint2 ) / slope2;
            for (j = 1; j <= (xstop−ibox2−feather_pixels); j++)
            {
                        red[out1] = imgR[in];
                grn[out1] = imgG[in];
                blu[out1] = imgB[in];
                mask[out1] = 1.0;
                out1−−;
                        in++;
            }
            for (j = 1; j <= feather_pixels; j++)
            {
                        red[out1] = imgR[in];
                grn[out1] = imgG[in];
                blu[out1] = imgB[in];
                mask[out1] = 1 − (float)j * feather;
                out1−−;
                        in++;
            }
            for (j = 1; j <= x8−xstop; j++)
            {
                        red[out1] = imgR[in];
                grn[out1] = imgG[in];
                blu[out1] = imgB[in];
                mask[out1] = 0.0;
                out1−−;
                        in++;
                }
        }
        else
        {
                for (j = 1; j <= x8−ibox2−feather_pixels; j++)
                {
                        red[out1] = imgR[in];
                grn[out1] = imgG[in];
                blu[out1] = imgB[in];
                mask[out1] = 0;
                out1−−;
                        in++;
                }
                for (j = 1; j <= feather_pixels; j++)
                {
                        red[out1] = imgR[in];
                grn[out1] = imgG[in];
                blu[out1] = imgB[in];
                mask[out1] = 1 - (float)j * feather;
```

APPENDIX A-continued

```
                        out1--;
                                in++;
                        }
                }
        }
        // Combine side image with front view image
    in = 0;
    for (i = 0; i < lines_out; i++)
        {
                out1 = i * pixels + x7;
                for (j = 1; j <= pixels_out; j++)
                {
                        imgR[out1] = (1. - mask[in]) * (float)imgR[out1] +
                                mask[in] * (float)red[in];
                        imgG[out1] = (1. - mask[in]) * (float)imgG[out1] +
                                mask[in] * (float) grn[in];
                        imgB[out1] = (1. - mask[in]) * (float)imgB[out1] +
                                mask[in] * (float)blu[in];
                        in++;
                        out1++;
                }
        }
        pixels_out = (ibox1 - x3) + (x7 - x4) + (x8 - ibox2);
// imgR[], imgG[], and imgB[] contain lines x pixels_out blended mask image
        delete []m_red;
        delete []m_grn;
        delete []m_blu;
        delete []mask;
}
```

PARTS LIST

10 Camera (electronic or digital)
12 Computer
14 Computer monitor displaying captured image
16 Digital image processing algorithm
18 Digital printer (thermal, inkjet, or electrophotographic)
20 Digital print
22 User (subject for mask image)
24 Adjustable mirror fixture
26 Mirror fixture lateral adjustment slots
28 Mirror fixture angular adjustment pivots
30 Right mirror
32 Left mirror
33 Sides of face
34 Cutout
35 Subject's ears
36 Mirror fixture image
37 Frame
38 Front image
40 Side images
42 Manually placed control points
44 Automatically connected control points
46 Selected areas of side images removed
48 Horizontally flipped side images
49 Image of mirror edge
50 Control points and connections removed
52 Side images moved laterally toward and blended with the front image
54 Front panel of head sock
56 Back panel of head sock
58 Assembled headsock (inside out)
60 Head sock seam
62 Head sock holding form
64 Assembled head sock (internal seam)
66 Thermal transfer (T-shirt) press
68 Head sock with transferred image
70 Completed mask
72 Eye hole
74 Ear slit
76 Mouth slit
100 Position and adjust mirrors step
102 Capture image and store step
104 Display image step
106 Place control points and start image processing step
108 Define and extract side image step
110 Flip side image step
112 Align and blend side image step
114 Optional feature selection step
116 Mirror and rescale image step
118 Print image step
120 Place head sock on form step
122 Align print step
124 Image transfer step
126 Remove from press step
128 Cut holes in mask step

We claim:

1. A method of making a photorealistic mask representing a photographic subject comprising the steps of:

a) simultaneously capturing a front and two side face views of the subject using a single camera and a pair of mirrors, one mirror on each side of the subject's head;

b) forming a digital image of the captured front and side views;

c) digitally processing the digital image by flipping the two side views and blending the two side views with the front view to form a blended image; and d) transferring the blended image to a head sock.

2. The method of making a photorealistic mask claimed in claim 1, wherein the blended image is transferred directly to the head sock by ink jet printing.

3. The method of making a photorealistic mask claimed in claim 1, wherein the blended image is transferred indirectly to the head sock by thennal re-transfer printing.

4. The method of making a photorealistic mask claimed in claim 3, wherein the blended image is printed on thermal retransfer media by an ink jet printer.

5. The method of making a photorealistic mask claimed in claim 3, wherein the blended image is printed on thermal retransfer media by a thermal printer.

6. The method of making a photorealistic mask claimed in claim 3, wherein the blended image is printed on thermal retransfer media by an electrophotographic printer.

7. The method of making a photorealistic mask claimed in claim 1, wherein the head sock is constructed from a cotton synthetic fiber blend fabric.

8. The method of making a photorealistic mask claimed in claim 1, wherein the fabric is 90/10 cotton lycra blend.

9. The method of making a photorealistic mask claimed in claim 1, wherein the step of digitally processing the digital image, further comprising the steps of:

a) placing control points at the outside corners of the eyes and mouth;

b) extracting relevant data from the front and side view using the control points;

c) flipping the extracted data from the side images horizontally; and d) aligning and blending the side images with the front image employing the control points.

10. The method of making a photorealistic mask claimed in claim 9, further comprising the step of resizing the image to fit the head sock.

11. The method of making a photorealistic mask claimed in claim 9, wherein the control points are placed manually.

12.The method of making a photorealistic mask claimed in claim 9, wherein the control points are placed automatically by a feature finding algorithm.

13. The method of making a photorealistic mask claimed in claim 1, further comprising the step of printing a backside image on the head sock.

14. The method of making a photorealistic mask claimed in claim 1, further comprising the step of adding decorative features to the digital image.

15. The method of making a photorealistic mask claimed in claim 1, further comprising the step of attaching additional articles to the finished mask.

16. The method of making a photorealistic mask claimed in claim 15, wherein the additional article is hair.

17. The method of making a photorealistic mask claimed in claim 15, wherein the additional article is a hood.

18. The method of making a photorealistic mask claimed in claim 15, wherein the additional article is a pair of horns, antennae, or antlers.

19. The method of making a photorealistic mask claimed in claim 15, wherein the additional article is a hat.

* * * * *